US006401619B2

(12) United States Patent
Lundin et al.

(10) Patent No.: US 6,401,619 B2
(45) Date of Patent: Jun. 11, 2002

(54) METHOD AND DEVICE FOR CLEANING THE GUIDE ROLLERS OF A WEB PRINTING PRESS

(75) Inventors: Kjell E. Lundin, Zwingenberg; Björn Mattis, Dieburg, both of (DE)

(73) Assignee: Oxy-Dry Maschinen GmbH, Egelsbach (DE)

( * ) Notice: Subject to any disclaimer, the term of this patent is extended or adjusted under 35 U.S.C. 154(b) by 0 days.

(21) Appl. No.: 09/783,500

(22) Filed: Feb. 14, 2001

(30) Foreign Application Priority Data

Feb. 14, 2000 (EP) ..... 00102950

(51) Int. Cl.[7] ..... B41F 35/00
(52) U.S. Cl. ..... 101/483; 101/424
(58) Field of Search ..... 101/483, 424, 101/425, 423, 417, 156, 167–169; 15/256.51, 256.52, 256.5

(56) References Cited

U.S. PATENT DOCUMENTS

| | | | | |
|---|---|---|---|---|
| 3,900,003 A | * | 8/1975 | Sato et al. | 101/211 |
| 4,538,541 A | * | 9/1985 | Zimmer | 118/258 |
| 4,781,116 A | | 11/1988 | Harada | 101/425 |
| 4,930,415 A | * | 6/1990 | Hara et al. | 101/425 |
| 5,080,015 A | | 1/1992 | Hansson et al. | 101/483 |
| 5,337,944 A | | 8/1994 | Shiba | 226/108 |
| 5,388,511 A | * | 2/1995 | Iijima | 101/483 |

FOREIGN PATENT DOCUMENTS

| | | |
|---|---|---|
| DE | 2203973 | 8/1973 |
| DE | 3736397 A1 | 5/1989 |
| EP | 0741035 A1 | 11/1996 |
| JP | 08300623 | 11/1996 |
| WO | 9852760 | 11/1998 |

* cited by examiner

*Primary Examiner*—Andrew H. Hirshfeld
*Assistant Examiner*—Anthony H. Nguyen
(74) *Attorney, Agent, or Firm*—Volpe and Koenig, P.C.

(57) ABSTRACT

The invention concerns a method and a device for cleaning guide rollers of a web printing press having a printing material web guided by a number of guide rollers, wherein cleaning liquid is applied onto the printing material web, is transported and transferred by same to the guide rollers and wherein the guide rollers to be cleaned are decelerated or accelerated while the printing material web is running, to generate slippage for removing the soiling. The printing material web is guided along a container for applying the cleaning liquid such that it has direct contact with the cleaning liquid contained in the container and thus automatically accepts cleaning liquid. In a preferred fashion, the sealing lip is elastically deformable for passing the cleaning liquid to the printing material web.

22 Claims, 6 Drawing Sheets

METHOD AND DEVICE FOR CLEANING THE GUIDE ROLLERS OF A WEB PRINTING PRESS

This application claims Paris Convention priority of EP 00 102 950.3 filed Feb. 4, 2000 the complete disclosure which is hereby incorporated by reference.

BACKGROUND OF THE INVENTION

The invention concerns a method for cleaning the guide rollers of a web printing press comprising a printing material web, guided by a number of guide rollers, and a corresponding device.

Automated cleaning devices have been known for some time for cleaning the cylinders of a web printing press which are directly involved in the printing process, e.g. rubber blanket cylinders and impression cylinders. Such a cleaning device comprises e.g. a brush roller which is moistened with cleaning liquids and introduced in a rotating fashion to the cylinder to be cleaned to dissolve and remove soiling therefrom, such as printing ink residues, loose paper fibers and paper dust.

With today's conventional printing speeds and increased requirements with regard to printing quality, it is absolutely necessary that those guide rollers which come into contact with the freshly printed printing material web are also regularly cleaned from impurities which accumulate on the guide roller surfaces, in particular, as adhering printing ink residues, paper dust and loose paper fibers, which would otherwise increasingly deteriorate the printing quality.

Since access to the guide rollers is usually difficult and since the number of guide rollers is very large compared to the number of cylinders directly involved in the printing process, it is usually not possible, in practice, to have one conventional automated cleaning device for each guide roller. The guide rollers are therefore conventionally cleaned by hand, with an operator spraying cleaning liquid onto the printing material web and initiating slow movement of the printing material web through the printing machine, wherein he/she manually decelerates a guide roller when the moistened portion of the printing material web moves over this guide roller to thereby generate slippage between the guide roller surface and the printing material web. The cleaning agent supplied, together with the printing material web, to the guide roller surface removes the soiling and the printing material web wipes over the respective guide roller to clean it.

U.S. Pat. No. 4,781,116 discloses a device which automates this long practiced approach for printing machines having paper webs. The system comprises an application device disposed in front of the guide rollers to be cleaned, which removes cleaning liquid from a basin using a dipping roller and applies same to a transfer roller, similar to the printing process, and which in turn contacts the paper web to which the entrained cleaning liquid is transferred. The paper web transports the applied cleaning liquid to the guide rollers to be cleaned, the guide rollers having driving motors which are coupled to the corresponding guide roller for generating a slippage between the paper web and the guide roller surface. This prior art has the associated problem that the transfer roller passes not only cleaning liquid onto the paper web but also impurities, in particular, paper dust, from the paper web back into the cleaning liquid container. This eventually leads to sludge deposits in the cleaning liquid container which have to be removed at regular intervals by hand.

U.S. Pat. No. 5,080,015 discloses a system for cleaning guide rollers of a web printing press based on the same conventional principle, wherein the guide rollers are simply decelerated for producing the required slippage and the cleaning liquid is applied to the paper web using spraying nozzles. The spraying nozzles eliminate the above-mentioned disadvantage of prior art according to U.S. Pat. No. 4,781,116 but there are still problems: Spraying always produces some atomization which causes undesirable operation risks. The risk to the workers breathing in the vapor is only one aspect. The cleaning liquids used e.g. for printing papers usually contain an oily component and thus the atomization precipitation on stairs and scaffoldings causes serious problems with respect to working safety. A further problem consists in spraying the optimum amount of cleaning liquids for each kind of paper web, the quality of which can rapidly change. Excessive cleaning liquid causes dripping. Too little cleaning liquid produces unsatisfactory cleaning results.

Departing from the above mentioned prior art, it is the underlying purpose of the invention to propose a method and a corresponding device, on the basis of the described principle, for cleaning the guide rollers of a web printing press which ensures reliable, safe, low-maintenance, automated cleaning of the guide rollers.

SUMMARY OF THE INVENTION

This object is achieved by a method and device comprising the features of the accompanying independent claims. Advantages further developments of the method and device can be extracted from the dependent claims.

The inventive method and the corresponding device are based on the known principle of applying cleaning liquid onto the printing material web and transporting it, using the printing material web, to the guide rollers to be cleaned, wherein the guide rollers to be cleaned are decelerated or accelerated while the printing material web is running to generate slippage between the printing material web and the surface of the respective guide roller such that soiling of the guide roller surface is wiped off and removed by the printing material web which is either charged with cleaning liquid and/or is dry. Depending on the printing material used, an optimum cleaning result can be achieved when slippage between the guide roller and the printing material web is produced while the moistened web contacts the guide roller. It may also be advantageous to move the moistened web over the guide rollers without slippage such that the printing ink residues adhering thereto are dissolved and the dissolved soiling is wiped off with a subsequent dry portion of the printing material web, i.e. slippage is produced only when the moistened web portion terminates.

In accordance with the invention, the cleaning liquid is neither applied to the printing material web using a transfer roller nor with spraying nozzles. For application of cleaning liquid, the printing material web is guided along a container holding cleaning liquid in such a fashion that it comes into direct contact with the cleaning liquid held in the container to thereby accept the cleaning liquid.

In accordance with the invention, optimum application of cleaning liquid onto the printing material web is achieved when the web accepts the cleaning liquid itself by soaking up the cleaning liquid—depending on the type of printing material web used—or by accepting a liquid film adhering to its surface due to adhesion forces and surface tension effects. The charging of the printing material web with cleaning liquid thus adapts automatically to the maximum or nearly maximum absorption capacity of the printing material web, without requiring any regulating measures. When the printing material is changed, no changes are required in the application of the cleaning liquid. At the same time, the surroundings of the application device are not influenced by the application of the cleaning liquid, in particular there is no disadvantageous atomization. Soiling of the stored cleaning liquid in the container is also unlikely since the printing material web only accepts cleaning liquid and the cleaning liquid does not flow back into the container. Finally, the application, in accordance with the invention, of liquid onto the printing material web is not negatively effected when printing material webs of different widths are used in the same machine. For application of liquid according to prior art, in particular using spraying nozzles, e.g. half of the spraying nozzles must be switched off when working with a printing material web which is only half as wide. This switching off must be coupled with information concerning which "half" of the printing material web is to be covered. In contrast thereto, in accordance with the invention, liquid is applied only when a printing material web is present. Application of liquid in accordance with the invention is therefore completely independent of the width and position of the printing material web.

There are various concrete embodiments of the invention. The printing material web may e.g. be dipped into the cleaning liquid contained in the container or guide along its surface. In the simplest case, the container is a basin with an open top. In a particularly preferred manner in accordance with the invention, the cleaning liquid is guided to the printing material web via an elastically deformable sealing lip disposed on the container. A sealing lip of this kind may be disposed, in particular, on the side of the container with the level of the cleaning liquid being slightly above the outer edge of the sealing lip. When the printing material web is guided past the sealing lip, it then accepts the liquid above the sealing lip under laminar flow thereof. The sealing lip thereby ensures that the cleaning liquid reaches the web without leaking.

In all these cases one must ensure that the level of the cleaning liquid in the container is held constant within close tolerances and independent of the amount of cleaning liquid removed by the printing material web. This is preferably achieved in that the container is provided with an overflow and simultaneously supplied with more cleaning liquid than can be removed by the printing material web. A dynamic balance is thereby generated which keeps the level constant within very close tolerances without having to provide sensors for level measurement and separate control circuits.

The cleaning liquid flowing out of the container via the overflow is preferably collected in a collector and the container is directly supplied with cleaning liquid from this collector to thereby form a circuit for the cleaning liquid from which cleaning liquid is only removed by the printing material web. The amount of cleaning liquid removed is added to this circuit e.g. from a supply tank with the collector preferably serving as a buffer.

The advantageously provided sealing lip is preferably adjusted at an acute angle with respect to the printing material web such that the cleaning liquid volume present above the sealing lip is reduced towards the outer edge provided for contact with the printing material web. This is advantageous with regard to possible spilling of the cleaning liquid. In addition, the printing material web abuts in a very flat manner on the sealing lip to greatly reduce the risk of web breakage.

The cleaning liquid container in accordance with the invention must be removed from the printing material web during normal operation of the printing machine to prevent disturbance of the printing process. Conversely, the container must address the printing material web for carrying out the inventive method. To keep the number of mechanical parts as small as possible, and mainly to minimize the space requirements of the container, advancement and withdrawal of a container comprising a sealing lip is preferably effected by pivoting the container about an axis extending parallel to the printing material web. For advancing the sealing lip to the printing material web, the container is tilted towards same. For termination of liquid application it is tilted away from same. This is not only efficient and space-saving but also permits, in particular, very rapid interruption of liquid application.

A pivotable container comprising a sealing lip of this kind is preferably dimensioned such that the cleaning liquid is safely below the outer edge of the sealing lip in the withdrawn position. When the container is pivoted towards the printing material web and the sealing lip contacts the printing material web, the level of the cleaning liquid is close to but not above the outer edge of the sealing lip. Further pivoting of the container towards the printing material web (which is possible due to the elastic deformability of the sealing lip) causes the level of the cleaning liquid to move above the edge of the sealing lip and the cleaning liquid comes into direct contact with the printing material web to be entrained thereby for passage to the guide rollers. When the sealing lip is withdrawn from the printing material web, the reverse effect is achieved. This geometry ensures that no cleaning liquid is spilled—even in event of an emergency switch-off.

With an optional overflow for keeping the liquid level on the side of the container opposite to the sealing lip constant, the edge of the overflow rises, as does the level of the cleaning liquid in the container, as soon as the container is pivoted towards the printing material web. This enhances the effect described above in a particularly simple fashion when the geometry has been appropriately selected. For fine adjustment purposes, the overflow may be designed in a height-adjustable or height-controllable fashion.

Further advantage can be achieved when the pivotable container is integrated in a stationary casing such that when the container is pivoted back, the sealing lip abuts an upper delimitation of the casing to close same. This ensures that the cleaning liquid, which usually has a low vapor pressure, does not evaporate during operation of the printing machine. Conversely, dust or similar soiling cannot gain access to the container during operation.

For reasons of safety, a collecting lip may be disposed below the sealing lip which contacts the printing material web at the same time or somewhat earlier than the sealing lip and which is connected to the collector. Cleaning liquid dripping from the sealing lip is then collected by the collecting lip and guided back into the collector, i.e. back into the circuit.

Should a casing be provided which is to be closed when the container has been pivoted back, the collecting lip may be formed such that, when the container has been pivoted, it abuts, at one side, against a lower delimitation of the casing and, on its other side, against the sealing lip to thereby close the casing. The casing thus includes not only the container with its sealing lip but also the collector for the cleaning liquid.

To limit application of cleaning liquid onto the printing material web to amounts below a maximum possible reception amount of the printing material web, a sealing lip having a toothed edge may be used. When the sealing lip contacts the printing material web, it yields in its direction of motion due to its elastic deformability, i.e. deforms. The individual teeth of a toothed edge of the sealing lip act as obstacles for the cleaning liquid such that same can gain access to the printing material web only at the intermediate spaces between the teeth. Depending on the ratio between the width of the teeth and the width of the tooth gaps, the resulting partial application of cleaning liquid to be printing material web delimits application of the cleaning liquid. The toothing may thereby have different shapes, e.g. comprising triangular or rectangular teeth and also rounded or wavy teeth.

A further particularly advantageous possibility to delimit application of cleaning liquid below a maximum possible amount which the printing material web can receive, consists in a cycled operation of the application device. When application of liquid onto the printing material web is activated and deactivated in rapid succession, the average amount of applied liquid amount can be adjusted—depending on the cycle times and intervals. This has the particular advantage that, in contrast to the toothed sealing lip, the structure of the application device must not be changed. Appropriate cycle control is sufficient. The cycling is particularly easy to carry out using a pivotable container comprising a sealing lip. In this event, a slight cycled tilting motion of the container is sufficient to achieve the desired liquid application effect. Tests with such an application device have shown that a cycle frequency on the order of 1 Hz generates liquid moistened strips of a few centimeters in length on a paper web for newspaper roller offset printing which alternate with associated dry web portions. The average amount of cleaning liquid transferred about the surface circumference of the guide roller to be cleaned can thus be accurately controlled.

The sealing lip may form at least part of the container wall facing the printing material web, wherein the container end face is provided with elastically deformable or foldable walls to seal the end faces of the container.

Supply of cleaning liquid into the container is preferably effected simultaneously at different locations distributed about its volume to avoid formation of turbulences within the container and decreases in or sloping of the cleaner level. Moreover, the cleaning liquid is preferably supplied from below the normal level to prevent impairment of the surface of the liquid and to avoid the formation of waves. This is achieved in a most simple fashion by disposing a duct element, having radial openings, within the container. This may be e.g. a pipe or tube comprising a plurality of bores distributed along its length.

To apply cleaning liquid to the printing material web from both sides, the application device may comprise two containers disposed on both sides of the printing material web. It is thereby particularly advantageous if the two containers are disposed facing one another since the two sealing lips mutually exert the required reaction force. If the reaction force must be produced by the web tension alone, the adjustment force of the sealing lip is poorly defined and the danger of web breakage is considerably increased.

Concrete embodiments of the invention are described and explained in more detail below with reference to the enclosed drawing.

DESCRIPTION OF THE PREFERRED EMBODIMENT

Figure 1:
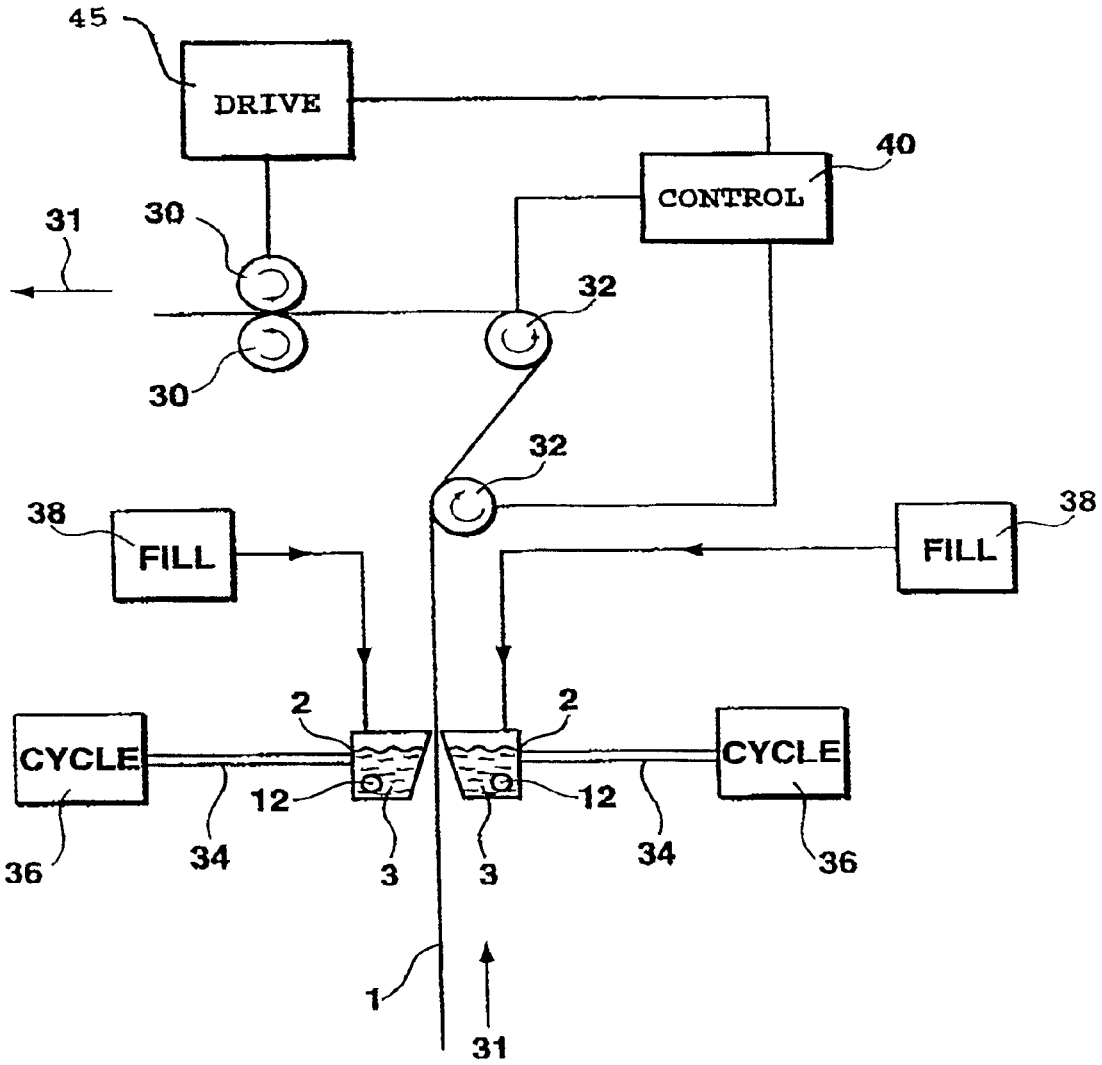
FIG. 1 schematically illustrates the system in accordance with the invention.

FIG. 1 schematically illustrates an overall system with which the device in accordance with the invention can be used. A paper web transport means 30 and a paper web drive 45 draw the paper web 1 in the direction of arrows 31 to pass by guide rollers 32. One container 2 is disposed on each side of the paper web 1 for applying cleaning liquid 3. Each container 2 is disposed to pivot about axis 12 as controlled by container drive 34. The frequency and timing of the container 2 pivoting is determined by cycle control 36. Guide roller brake/drive control 40 communicates with the paper web drive 45 and the guide rollers 32 to control the velocity of the guide rollers 32 relative to the paper web 1.

Figure 2:
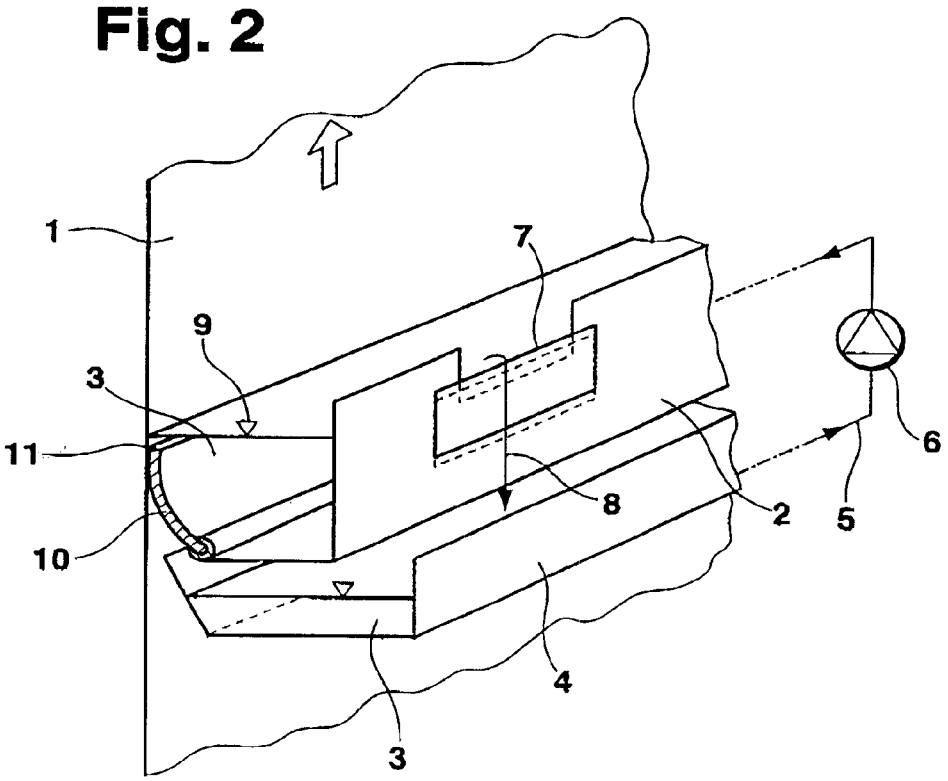
FIG. 2 shows a schematic perspective partial section through an application device in accordance with the invention.

FIG. 2 shows a schematic view of an inventive application device adjacent to the side of a paper web 1, extending vertically upwards. The application device itself comprises a container 2 with an open top containing cleaning liquid 3 and a collector 4 disposed therebelow from which the cleaning liquid 3 is supplied into the container 2 via a supply 5 and pump 6. Excess cleaning liquid 3 in the container 2 flows, via the overflow 7, in the direction of arrow 8 into the collector 4 to keep the level 9 of the cleaning liquid 3 in the container 2 constant, independent of the amount removed by the paper web 1. As indicated in the drawing, the overflow 7 and thus the level 9 can be height-adjusted. The wall of the container 2 facing the paper web 1 is formed by an elastically deformable sealing lip 10 which consists e.g. of polyoxymethylene or polyethylene. These materials are relatively hard and frictionally resistant and yet resilient. As clearly shown, the sealing lip 10 addresses the paper web 1 at an acute angle to provide as smooth a contact as possible. The outer edge 11 of the sealing lip 10 contacting the paper web 1 is disposed several millimeters below the level 9 of the cleaning liquid 3 such that the paper web 1 is in direct contact with the cleaning liquid 3 in the container 2 and removes, via adhesives forces, surface tension effects and in laminar flow, an amount of cleaning liquid 3 which effects optimum charging of the paper web 1. The amount of cleaning liquid 3 removed from the container 2 by the paper web 1 is added to the device from the container 2 and collector 4 such that the collector 4 also serves as buffer for the cleaning liquid circuit.

As can be seen from FIG. 2, there are several possibilities to advance the inventive application device to the paper web 1 for cleaning the guide rollers and for withdrawal thereof after cleaning. For example, a linear, lateral approach and withdrawal is possible. Alternatively, the container 2 can be pivoted about an axis extending parallel to the plane 1 of the paper web. Pivoting of the sealing lip 10 only is also possible.

Figure 3:
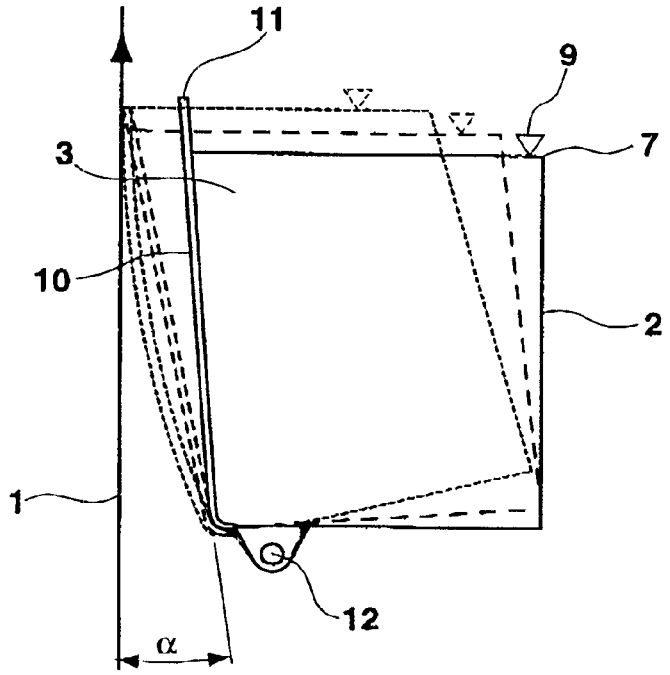
FIG. 3 shows a schematic sectional representation of a container for cleaning liquid.

FIG. 3 schematically shows a particularly preferred embodiment according to the invention in which the entire container 2 is pivoted about an axis 12 to advance the application device to the paper web 1. The solid lines show the container 2 in its withdrawn position at which the level 9 of the cleaning liquid 3 is clearly below the outer edge 11 of the sealing lip 10. Pivoting about the axis 12 permits movement of the sealing lip 10 onto the paper web 1 under an acute angle α. The point in the time when the edge 11 of the sealing lip 10 contacts the paper web 1 is shown with dashed lines. At this stage, the level 9 is still slightly below the edge 11 of the sealing lip 10. Application of liquid onto the paper 1 web does not yet occur. Further pivoting of the container 2 about the axis 12 towards the paper web 1 deforms the sealing lip 10 and at the same time lifts the overflow 7 above the edge 11 such that—as shown with dotted lines—the level 9 of the cleaning liquid 3 is above the edge of the sealing lip 10 thereby producing direct contact between the paper web 1 and the cleaning liquid 3. The paper web 1 accepts cleaning liquid 3 and transports it to the guide rollers. This figure clearly shows that the application device can be advanced to and withdrawn from the paper web 1 in a very rapid and well-defined fashion.

Figure 4:
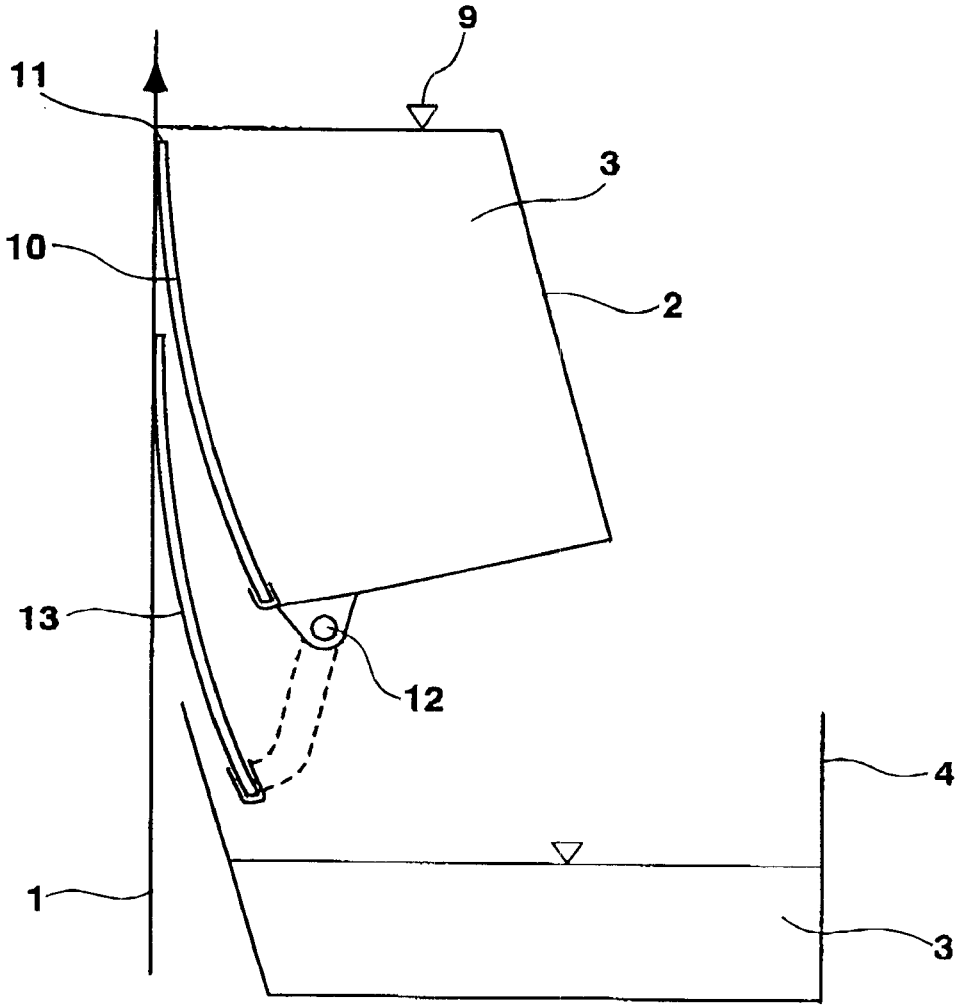
FIG. 4 is a representation according to FIG. 3 of another embodiment.

FIG. 4 shows a schematic representation similar to that of FIG. 3 wherein the application device is advanced to the paper web 1 and is provided with a sealing lip 10 and an additional collecting lip 13. The collecting lip 13 is pivoted, together with the container 2, about the axis 12 and contacts the paper web 1 before the sealing lip 10 activates application of liquid. When cleaning liquid 3 moves over the edge 11 of the sealing lip 10 due to formation of waves in the container 2 or other irregularities, before the sealing lip 10 contacts the paper web 1, this liquid is collected by the collecting lip 13 and guided into the collector 4.

Figure 5:
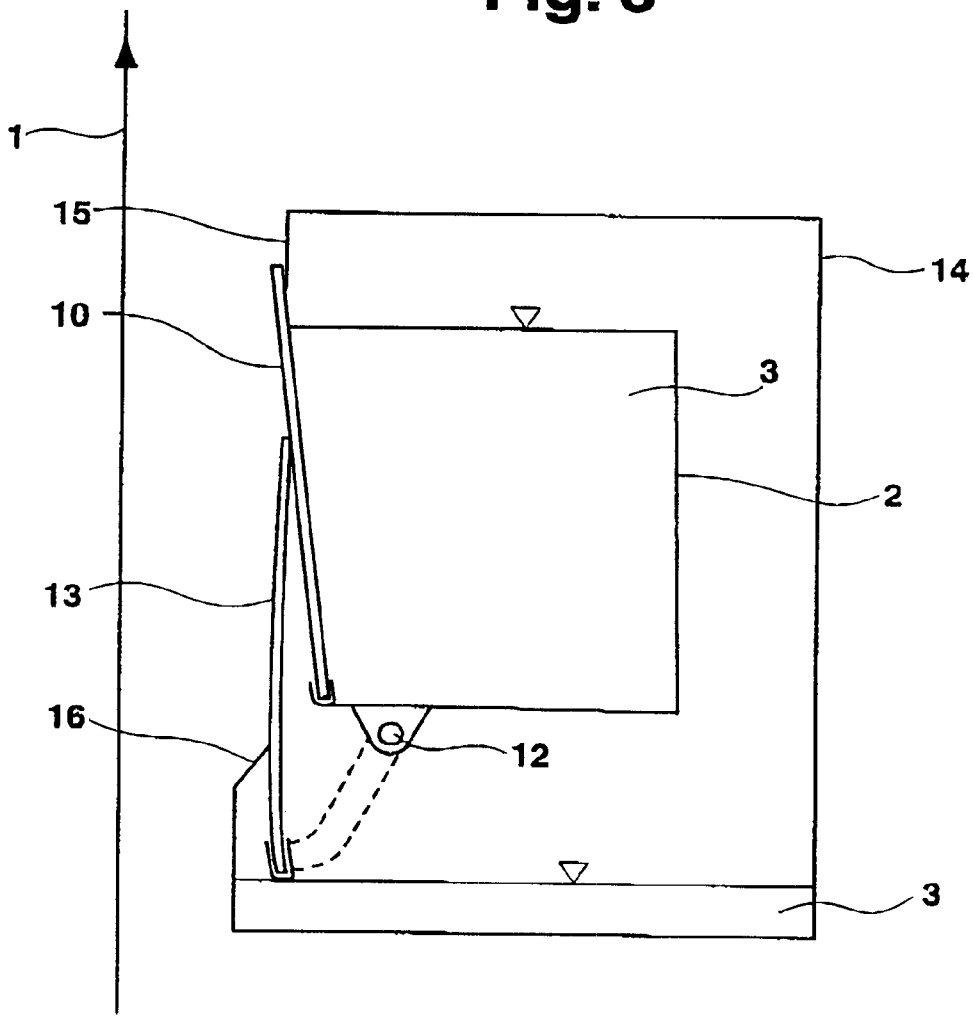
FIG. 5 is a representation according to FIG. 4 of another embodiment.

FIG. 5 shows a representation similar to that of FIG. 4 wherein the application device is withdrawn from the paper web 1 and is provided with a casing 14 for protecting the cleaning liquid 3 from soiling. The casing 14 has an upper delimination 15 and a lower delimination 16 which ensure, in cooperation with the sealing lip 10 and the collecting lip 13, complete closing of the casing 14 as soon as the container 2 has been completely pivoted back.

Figure 6:
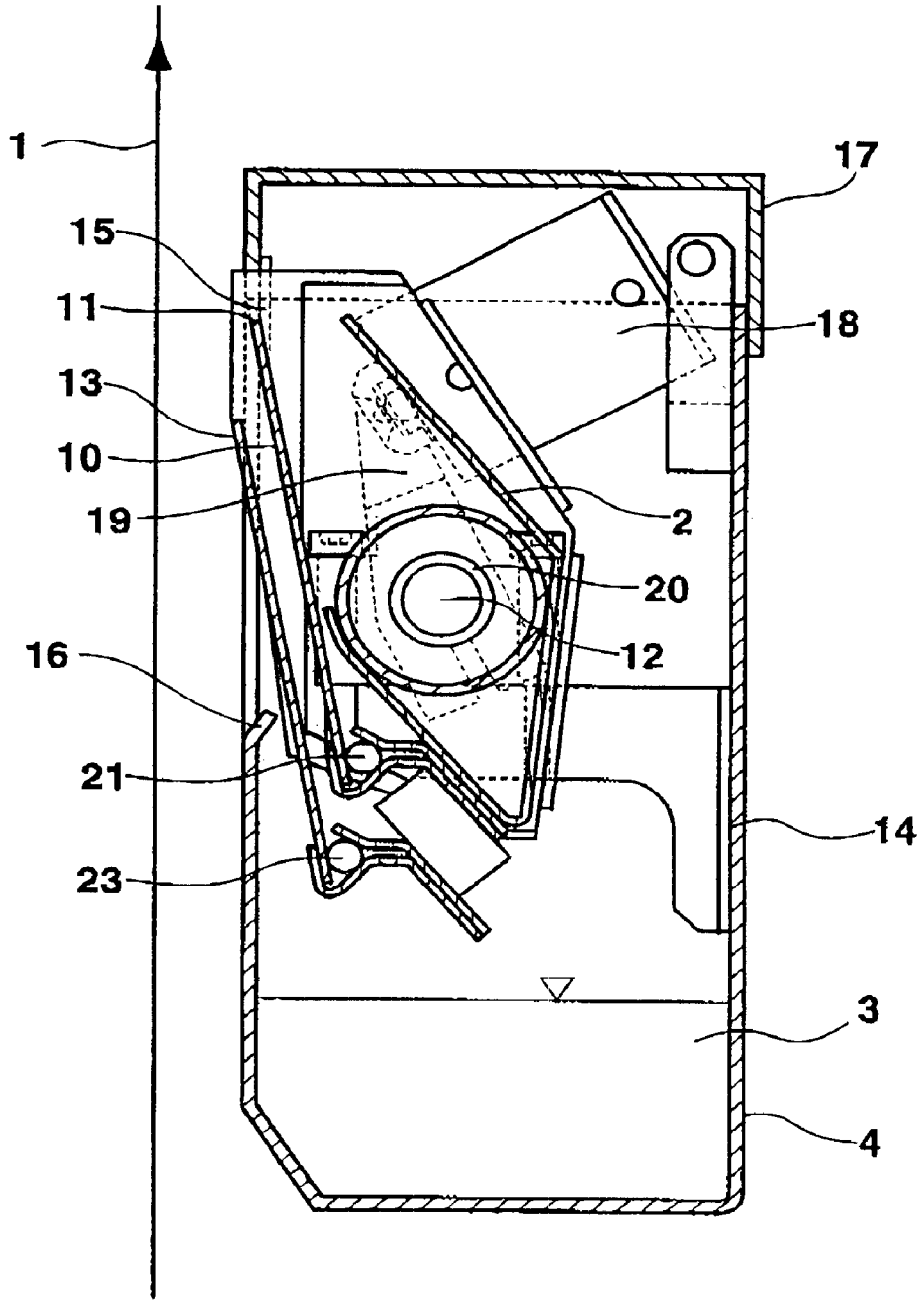
FIG. 6 is a sectional representation, to scale, of an inventive application device.

FIG. 6 shows a schematic section through an application device in accordance with the invention according to scale, wherein the container 2 comprises a sealing hip 10 and a collecting lip 13. A casing 14, with integrated collector 4, is provided for the cleaning liquid 3. The casing 14 has a lid 17 which can be removed for maintenance and which is tightly closed via the sealing lip 10, the collecting lip 13, the upper delimitation 15 and the lower delimitation 16 when the container 2 is completely pivoted back. The container 2 is pivotably disposed about the axis 12 such that when advanced, first the collecting lip 13 and then the sealing lip 10 contact the paper web 1. The pivoting motion is effected via a piston-cylinder unit 18 which is preferably operated with pressurized air. A lever 19 converts the linear motion of the piston cylinder unit 18 into a rotary movement. The lever 19 engages a pipe 20 passing through the entire container 2 in a longitudinal direction and is provided with a plurality of bores distributed about its length. This pipe 20 functions not only as a bearing for the pivoting motion but at the same time as a duct element for supplying cleaning liquid 3 to the container 2. FIG. 6 also shows that both the sealing lip 10 and the collecting lip 13 are seated in holders 21 and 22 and can be easily replaced. This is advantageous since the paper web 1 has relatively large abrasive properties.

Figure 7:
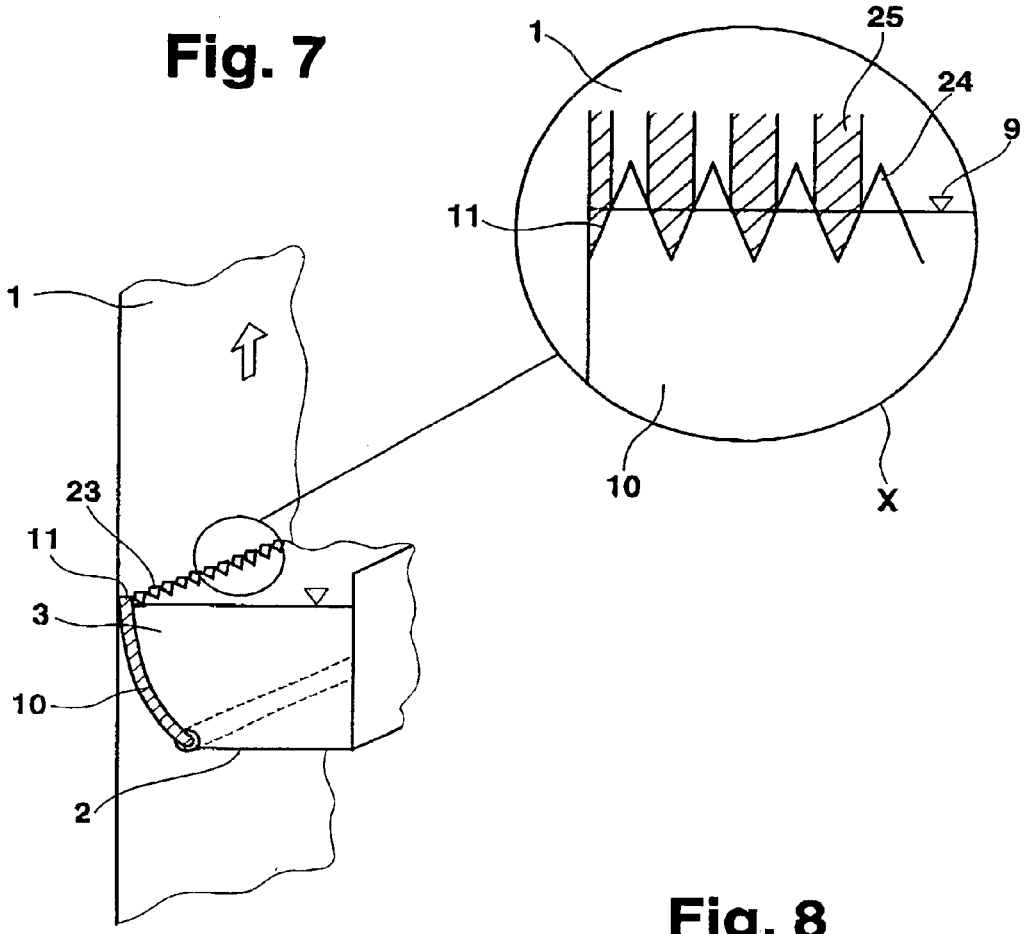
FIG. 7 shows a schematic representation of further embodiment of an application device showing details in enlarged view.

FIG. 7 shows an embodiment in which a reduced amount of cleaning liquid is applied to the paper web 1 via a toothed edge 11 of the sealing lip 10. As shown in the detailed representation X, the level 9 of the cleaning liquid 3 is set such that its projection onto the paper web 1 lies in the region of the toothing 23. In this manner, contact between the cleaning liquid 3 and the paper web 1 is only possible in the gaps between the individual teeth 4 so that only partial application of the cleaning liquid film 25 is possible.

Figure 8:
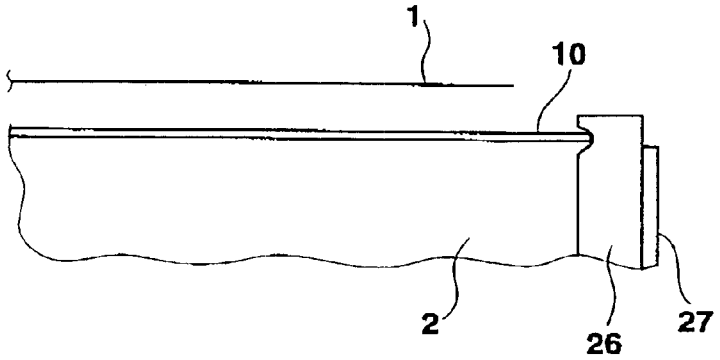
FIG. 8 shows a schematic top view onto the edge region of an inventive application device.

FIG. 8 finally shows a schematic plan view onto the end face delimination of a container 2, as also represented in FIG. 2. Since the wall of the container 2 facing the paper web 1 is formed by the sealing lip 10 which elastically deforms during advancement of the container 2 onto the paper web 1, the connection between the sealing lip 10 and the end face of the container 2 should not be rigid. According to the embodiment shown herein, the end face consists of an easily deformable foamed sealing 26 and a fixed supporting sheet metal 27. The sealing lip 10 may move relative to the supporting sheet metal 27 whereas the yielding foamed sealing 26 ensures sealing of the container 3 at its end face.

It should finally be noted that the invention is not limited to the embodiments represented. The inventive method and the corresponding device are suited not only for web printing press having paper webs but may also be used for other web-like printing materials, such as e.g. textiles. A horizontally disposed sealing lip or a web extending differently with respect to those illustrated herein—with or without sealing lip—also lie within the scope of the inventive teaching. The inventive container can have other shapes which may differ considerably from the shapes shown in the drawing.

LIST OF REFERENCE NUMERALS

1 paper web
2 container
3 cleaning liquid
4 collecting container
5 supply
6 pump
7 overflow
8 arrow
9 level
10 sealing lip
11 edge
12 axis
13 collecting lip
14 casing
15 delimitation (upper)
16 delimitation (lower)
17 lid (of 14)
18 piston-cylinder unit
19 lever
20 pipe
21 holder (of 10)
22 holder (of 13)
23 toothing
24 teeth
25 cleaning liquid film
26 foamed sealing
27 supporting sheet metal
α angle
X detail
30 paper web transport means
31 paper web travel

32 guide roller
34 container drive
36 cycle control
38 cleaning liquid fill
40 guide roller brake/drive control
45 paper web drive

What is claimed is:

1. A method for cleaning guide rollers of a web printing press having a printing material web guided a plurality of guide rollers, the method comprising the steps of:

a) filling a first container with cleaning liquid;

b) guiding the printing material web along said first container such that the printing material web directly contacts the cleaning liquid, wherein cleaning liquid is accepted by the printing material web via an elastically deformable sealing lip disposed on said first container;

c) passing the printing material web, following step b), past the guide rollers to contact the guide rollers with portions of the printing material web having accepted cleaning liquid;

d) creating a difference between rotational velocities of the guide roller and a velocity of the printing material web past the guide rollers to produce slippage between the printing material web and a surface of the guide rollers, whereby soiling of the guide roller surface is removed by the printing material web.

2. The method of claim 1, further comprising holding a level of the cleaning liquid in said first container substantially constant via an overflow and an over-proportionally large supply of cleaning liquid dispensed into said first container.

3. The method of claim 1, further comprising cycling application of the cleaning liquid onto the printing material web to control an average amount of applied cleaning liquid.

4. The method of claim 1, wherein said sealing lip addresses the printing material web at an acute angle.

5. The method of claim 1, wherein step b) comprises the step of advancing said sealing lip to the printing material web through pivoting of said first container about an axis extending parallel to a plane of the printing material web.

6. The method of claim 5, wherein step b) comprises the step of initially contracting the printing material web to elastically deform said sealing lip and subsequently further pivoting said first container towards the printing material web until a level of the cleaning liquid in said first container is above an edge of said sealing lip abutting against the printing material web, wherein said level of the cleaning liquid is below said edge when said first container assumes a pivot position in which said sealing lip does not contact the printing material web.

7. The method of claim 1, wherein step a) comprises simultaneously supplying the cleaning liquid to said first container at different locations distributed about a first container volume, said different locations being disposed below a usual cleaning liquid level.

8. The method of claim 1, further comprising disposing a second container holding cleaning liquid to face said first container for applying cleaning liquid to both sides of the printing material web.

9. A device for cleaning guide rollers of a web printing press having a printing material web guided by a plurality of guide rollers, comprising:

a first container;

means for filling said first container with cleaning liquid;

means for guiding the printing material web along said first container such that the printing material web directly contacts the cleaning liquid, wherein cleaning liquid is accepted by the printing material web;

means for passing the printing material web past the guide rollers to contact the guide rollers with portions of the printing material web that have accepted cleaning liquid; and means for creating a difference between rotational velocities of the guide roller and a velocity of the printing material web past the guide rollers to produce slippage between the printing material web and a surface of the guide rollers, whereby soiling of the guide roller surface is removed by the printing material web, wherein said first container comprises an elastically deformable sealing lip for contact with the printing material web.

10. The device of claim 9, further comprising a second container disposed facing said first container, said second container for apply cleaning liquid to an opposite side of the printing material web.

11. The device of claim 9, wherein said velocity difference creating means comprise at least one of a deceleration and a driving device means for each guide roller to be cleaned.

12. The device of claim 9, wherein said means for filling said first container comprises a supply for cleaning liquid and an overflow for keeping a level of the cleaning liquid substantially constant.

13. The device of claim 12, further comprising a collector with which said first container communicates via said overflow and said supply.

14. The device of claim 9, further comprising means for cycling direct contact between the printing material web and the cleaning liquid contained in said first container to control the cleaning liquid applied onto the printing material web.

15. The device of claim 9, wherein said guiding means comprise means for pivoting said container about an axis extending parallel to a plane of the printing material web to advance said sealing lip onto the printing material web.

16. The device of claim 15, wherein said guiding means comprise means for further pivoting said first container towards the printing material web after said sealing lip just contacts the printing material web under elastic deformation until a level of the cleaning liquid in said first container is above an edge of said sealing lip abutting the printing material web, wherein said level of the cleaning liquid is set such that it is below said edge as long as said sealing lip is not in contact with the printing material web.

17. The device of claim 16, further comprising a stationary casing in which said first container is integrated in such a fashion that said sealing lip abuts an upper delimination of said casing when said first container is pivoted back to thereby close said casing.

18. The device of claim 9, further comprising a collector with which said first container communicates via said overflow and said supply, and with a collecting lip disposed below said sealing lip for further contact with the printing material web, wherein said collecting lip is connected to said collector.

19. The device of claim 12, further comprising a collector with which said first container communicates via said overflow and said supply, a stationary casing in which said first container is integrated in such a fashion that said sealing lip abuts and upper delimination of said casing when said first container is pivoted back to thereby close and casing, and a collecting lip disposed below said sealing lip for further contact with the printing material web, wherein said collecting lip is connected to said collector, and wherein, when said first container has been pivoted back, said collecting lip abuts, on one side, against a lower delimination of said casing for closing said casing and abuts, on its other side, against said sealing lip.

20. The device of claim 9, wherein said sealing lip comprises one of a straight and toothed edge for contact with the printing material web.

21. The device of claim 9, wherein sealing lip forms at least part of a first container wall facing the printing material web, wherein an end face of said first container comprises one of an elastically deformable and foldable walls member.

22. The device of claim 9, wherein said filling means comprise a duct element having radial openings for supplying the cleaning liquid to said first container.

* * * * *